US011053635B2

(12) United States Patent
Regier et al.

(10) Patent No.: US 11,053,635 B2
(45) Date of Patent: Jul. 6, 2021

(54) METHOD AND APPARATUS FOR FEEDING LAUNDRY ITEMS TO, IN PARTICULAR, A MANGLE

(71) Applicant: Herbert Kannegiesser GmbH, Vlotho (DE)

(72) Inventors: Eduard Regier, Leopoldshöhe (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 119 days.

(21) Appl. No.: 16/409,162

(22) Filed: May 10, 2019

(65) Prior Publication Data

US 2019/0352839 A1 Nov. 21, 2019

(30) Foreign Application Priority Data

May 15, 2018 (DE) ..... 102018003878.6
Aug. 16, 2018 (DE) ..... 102018006466.3

(51) Int. Cl.
*D06F 67/04* (2006.01)

(52) U.S. Cl.
CPC ..... *D06F 67/04* (2013.01)

(58) Field of Classification Search
CPC ..... D06F 67/00; D06F 67/04; D06F 95/00; B65G 47/02; B65G 47/90; B65G 47/04; B65H 9/12
See application file for complete search history.

(56) References Cited

U.S. PATENT DOCUMENTS 3,706,450 A * 12/1972 Gerstenberger ..... D06F 89/00 493/14
4,338,282 A * 7/1982 Motooka ..... D06F 95/00 134/15

(Continued)

FOREIGN PATENT DOCUMENTS

EP 2045391 A2 4/2009
EP 3147405 A1 3/2017

(Continued)

OTHER PUBLICATIONS

European Patent Office, Europaischer Recherchenbericht (searchin a related application), Sep. 5, 2019.

*Primary Examiner* — Ismael Izaguirre
(74) *Attorney, Agent, or Firm* — Laurence P. Colton; Smith Tempel Blaha LLC

(57) ABSTRACT

A method and apparatus that makes provision for the length of a transverse edge of a laundry item to be spread out to be determined upstream of the spreading device. It is thereby possible to determine the length of the transverse edge for each individual laundry item before the laundry item is situated in the spreading device. For this purpose, the length of the laundry item is determined in the region of corner locators provided upstream of the spreading device, and the width of the laundry item, which corresponds to the length of the transverse edge, is derived therefrom. The length dimension of the transverse edge thus determined upstream of the spreading device is then used to move apart the spreading clamps of the spreading device in a targeted and controlled manner in order to spread out the transverse edge in as gentle a manner as possible.

13 Claims, 8 Drawing Sheets

(56) References Cited

U.S. PATENT DOCUMENTS

| | | | | | |
|---|---|---|---|---|---|
| 4,463,944 | A * | 8/1984 | Grantham | B65H 31/3054 | 271/175 |
| 4,774,505 | A * | 9/1988 | Ueda | B61B 10/025 | 198/464.3 |
| 8,028,444 | B2 * | 10/2011 | Heinz | D06F 95/00 | 38/143 |
| 9,187,253 | B2 * | 11/2015 | Olivieri | D06F 67/04 | |

FOREIGN PATENT DOCUMENTS

| | | | |
|---|---|---|---|
| EP | 3181752 | A1 | 6/2017 |
| EP | 3301218 | A2 | 4/2018 |

* cited by examiner

METHOD AND APPARATUS FOR FEEDING LAUNDRY ITEMS TO, IN PARTICULAR, A MANGLE

CROSS REFERENCE TO RELATED APPLICATIONS

This patent application claims priority on and the benefit of German Patent Application No. 10 2018 003 878.6 having a filing date of 15 May 2018 and German Patent Application No. 10 2018 006 466.3 having a filing date of 16 Aug. 2018.

BACKGROUND OF THE INVENTION

Technical Field

The invention relates to a method for feeding laundry items to, in particular, a mangle or to another laundry treatment device, a respective laundry item held at two adjacent corner regions or corners of an upper transverse edge by two spreading clamps of a spreading device being spread out by targeted movement apart of the spreading clamps while taking into consideration the determined length of the transverse edge, in order to eliminate or at least as far as possible eliminate a sag of the front transverse edge of the laundry item. The invention further relates to an apparatus for feeding laundry items to a mangle or to another laundry treatment device, having a spreading device which has at least two spreading clamps, which can be moved apart and together, for adjacent corner regions or corners of a front transverse edge of the respective laundry item, and having at least one detection means for determining at least one dimension of the laundry item.

Prior Art

Laundry items, specifically in particular so-called flat linen such as table linen, bed linen and the like, are fed from a feeding machine to a following laundry treatment device, for example a mangle. The laundry items are first spread out by the feeding machine in order, in the spread-out state, to be able to be fed to the following laundry treatment machine, for example mangle.

To spread out the laundry items, feeding machines have a spreading device with one or more spreading clamp pairs. Each spreading clamp pair has two spreading clamps which can be moved apart and together transversely to the feeding direction of the laundry items to be spread out to the following laundry treatment device. When moving apart the spreading clamps, which respectively hold a laundry item, of the respective spreading clamp pair, the laundry item held by the spreading clamps is spread out and in so doing a sag between adjacent corner regions of the front transverse edge of the laundry item which are held by the spreading clamps of the respective spreading clamp pair is at least reduced, preferably approximately eliminated. The spreading clamps can also be moved in such a way that they center the respective laundry item centrally on the intended feed path of the feeding machine.

The spreading out of the laundry item may only occur in such a way that the transverse edge, which is held between adjacent corner regions, in particular corners, by the spreading clamps of the respective spreading clamp pair, and which is also referred to in the following as "front transverse edge to be stretched out", is not exposed to excessive tensile loading.

It is already known to avoid the excessive stretching of the transverse edge, which is to be spread out and which leads in the feeding direction, of the laundry item by measuring the length of the front transverse edge of the laundry item. With respect to the feeding direction of the laundry item, the length of the front transverse edge corresponds by definition to the width thereof, which as a rule can be smaller but also greater than the length of the laundry item. The measurement of the length of the transverse edge or of the width of the laundry item occurred hitherto after suspending the latter in the spreading clamps. This adversely affects the duration of the spreading operation, because the length of the front edge or the width of the respective laundry item has to be determined during the spreading of the latter.

BRIEF SUMMARY OF THE INVENTION

The object on which the invention is based is to provide a method and an apparatus for feeding laundry items to, for example, a mangle, whereby the respective laundry item can be reliably spread out to a sufficient extent and above all also in a gentle manner.

A method for achieving this object is a method for feeding laundry items to a mangle or to another laundry treatment device, a respective laundry item held at two adjacent corner regions or corners of an upper transverse edge by two spreading clamps of a spreading device being spread out by targeted movement apart of the spreading clamps while taking into consideration the determined length of the transverse edge, in order to eliminate or at least as far as possible eliminate a sag of the front transverse edge of the laundry item, wherein, before transferring the corner regions or corners of the front transverse edge of the laundry item to the spreading clamps, with the laundry item held by holding means arranged upstream of the spreading device, a measurement of said laundry item is carried out and the length of the front transverse edge of the laundry item is determined therefrom. Accordingly, there is provision, even before transferring the adjacent corner regions of the transverse edge of the laundry item to the spreading clamps, to measure, in the influencing region of holding means arranged upstream of the spreading device, the laundry item instantaneously held by said holding means. As a result, the length, which extends (as seen in the feeding direction) over the width of the laundry item, of the front transverse edge of the respective laundry item can preferably be determined before the laundry item is spread by this transverse edge by the spreading device. The length of the front transverse edge of the respective laundry item is thus already known before the latter is spread out. As a result, the spreading device is freed from the determination of the length of the front transverse edge of the respective laundry item, and the spreading operation, in particular its cycle time, is shortened.

There is preferably provision to determine the width of the laundry item, which corresponds to the length of the transverse edge of the laundry item, before transferring the latter to the spreading device. As a result, the degree by which the spreading clamps must move apart in order to spread the front transverse edge of the laundry item to the intended extent is already known before the laundry item is fed into the spreading clamps. Thus, after feeding in the laundry item, the spreading clamps can immediately be moved apart in a targeted and controlled manner.

There is preferably provision that, to determine the length of the transverse edge and/or the width of the laundry item, first the length of the laundry item between the front transverse edge held by the holding means and the opposite rear transverse edge is measured, and the width of the laundry item, which corresponds to the length of the front transverse edge, is derived from the measured length of the laundry item and/or the measured spacings of the transverse edges. The length of the laundry item, that is to say the spacing between the adjacent front and rear transverse edges thereof, can be easily determined during further transport of the respective laundry item to the spreading device. In particular, this measurement can take place with relatively high reliability and simple detection means.

According to a preferred embodiment of the method, there is provision that the length of the transverse edges, in particular of the front transverse edge, of the laundry item and the resulting width thereof are derived from the determined length of the laundry item held on the holding means. This preferably occurs on the basis of lengths and widths and/or length-width ratios of different laundry items stored in a data bank, in particular different occurring laundry items or laundry items fed hitherto to the feeding machines by the method. Here, the starting point is the finding that a corresponding width belongs to each laundry item having a certain determined length and/or the laundry items have certain length-width ratios.

After the length of the laundry item has been measured, the width of the laundry item belonging to this length can be automatically taken from the data bank. This width of the laundry item corresponds to the length of the front transverse edge of the laundry item and thus to the spreading extent to which the spreading clamps of the spreading device have to spread out the front transverse edge of the laundry item in order that the sag of this transverse edge is eliminated or at least approximately eliminated, and the spread-out laundry item can subsequently be fed to a mangle or to another following laundry treatment device.

Other development possibilities of the method make provision that, after determining the length of the laundry item, with corner regions, preferably corners, on opposite ends of the front transverse edge of the laundry item being held by the holding means, said laundry item is transferred directly from the holding means to two spreading clamps of a spreading clamp pair. Alternatively, there can be provision that the corner regions or corners of the respective measured laundry item are first transferred from the holding means to other holding means which only then transfer the laundry item to the two spreading clamps of a respective spreading clamp pair by adjacent corners or corner regions of the measured front or upper transverse edge. The stated procedures ensure that the leading transverse edge of the respective laundry item is measured before it is transferred to the spreading clamps. The resulting width of the laundry item or length of the transverse edge is thus already known before the laundry item comes into the influencing region of the spreading device. The spreading operation of the laundry item can thus occur rapidly because a measurement no longer has to be carried out during the spreading operation. In addition, the length of the front edge of the respective laundry item can be determined during the further transport thereof. The measurement of the respective laundry item thus occurs as it were dynamically without time loss.

An advantageous development of the method makes provision that the length of the laundry item is determined by the at least one detection means with the laundry item held with sagging transverse edges by the holding means. Since the sags of the two adjacent transverse edges of the as yet non-spread-out laundry item are preferably approximately the same size, the length of the laundry item can be determined before the spreading thereof with relatively high accuracy. The measurement can occur, for example, at the point of the largest sag in the center of the leading transverse edge to the point of the largest, preferably central sag of the other, trailing transverse edge. On the basis of the measured length of the laundry item, the associated width of the laundry item measured with respect to the length is then determined, in particular retrieved, from the data bank. On the basis of this width, the laundry item is then later spread out in a targeted manner in the spreading device, with, in particular, the sag of the upper transverse edge of the laundry item being eliminated or at least approximately eliminated in a targeted manner.

An apparatus for achieving the object stated at the outset is an apparatus, in particular feeding machine, for feeding laundry items to a mangle or to another laundry treatment device, having a spreading device which has at least two spreading clamps, which can be moved apart and together, for adjacent corner regions or corners of a front transverse edge of the respective laundry item, and having at least one detection means for determining at least one dimension of the laundry item, wherein the at least one detection means is assigned to holding means of the laundry item that are arranged upstream of the spreading device. In this apparatus, there is provision to assign at least one detection means to the holding means arranged upstream of the spreading device. As a result, the measurement of the respective laundry item can already occur upstream of the spreading device. The measurement therefore no longer need occur during the spreading of the laundry item. As a result, the spreading out of the laundry item and stretching out of the front transverse edge thereof by the spreading device can occur more quickly because the spreading clamps can move apart the corners of the front transverse edge in a targeted and controlled manner immediately after the transfer or acceptance of the laundry item.

In a preferred embodiment of the apparatus, there is provision to design the holding means as corner locators assigned to opposite longitudinal edges and/or corners or corner regions of the laundry item. The corner locators transport the respective laundry item at the longitudinal edges starting from the adjacent corners of the leading transverse edge to the adjacent corners of the opposite, following transverse edge of the laundry item. During this further transport of the laundry item, the length thereof can be reliably determined. The length measurement can thus occur continuously or dynamically, with the result that the cycle time is not increased thereby, because the measurement does not require a standstill of the laundry item.

In an advantageous embodiment of the apparatus, there is provision to arrange the at least one detection means between the corner locators assigned to opposite longitudinal edges and/or corner regions of the laundry item. This preferably occurs in such a way that a measurement axis of the at least one detection means, directed transversely to the plane of the surface of the laundry item, intersects the sagging transverse edges, preferably at their lowest points, and detects the running past of the respective transverse edge. The lowest points of the transverse edges, which run past the detection means in succession, of the respective laundry item form defined measurement points which allow a simple, contactless, but precise measurement of the length of the laundry item during its further transport by the holding means.

BRIEF DESCRIPTION OF THE DRAWINGS

A preferred exemplary embodiment of the invention will be explained in more detail below with reference to the drawings. In this drawings.

DETAILED DESCRIPTION OF PREFERRED EMBODIMENTS

Figure 1:
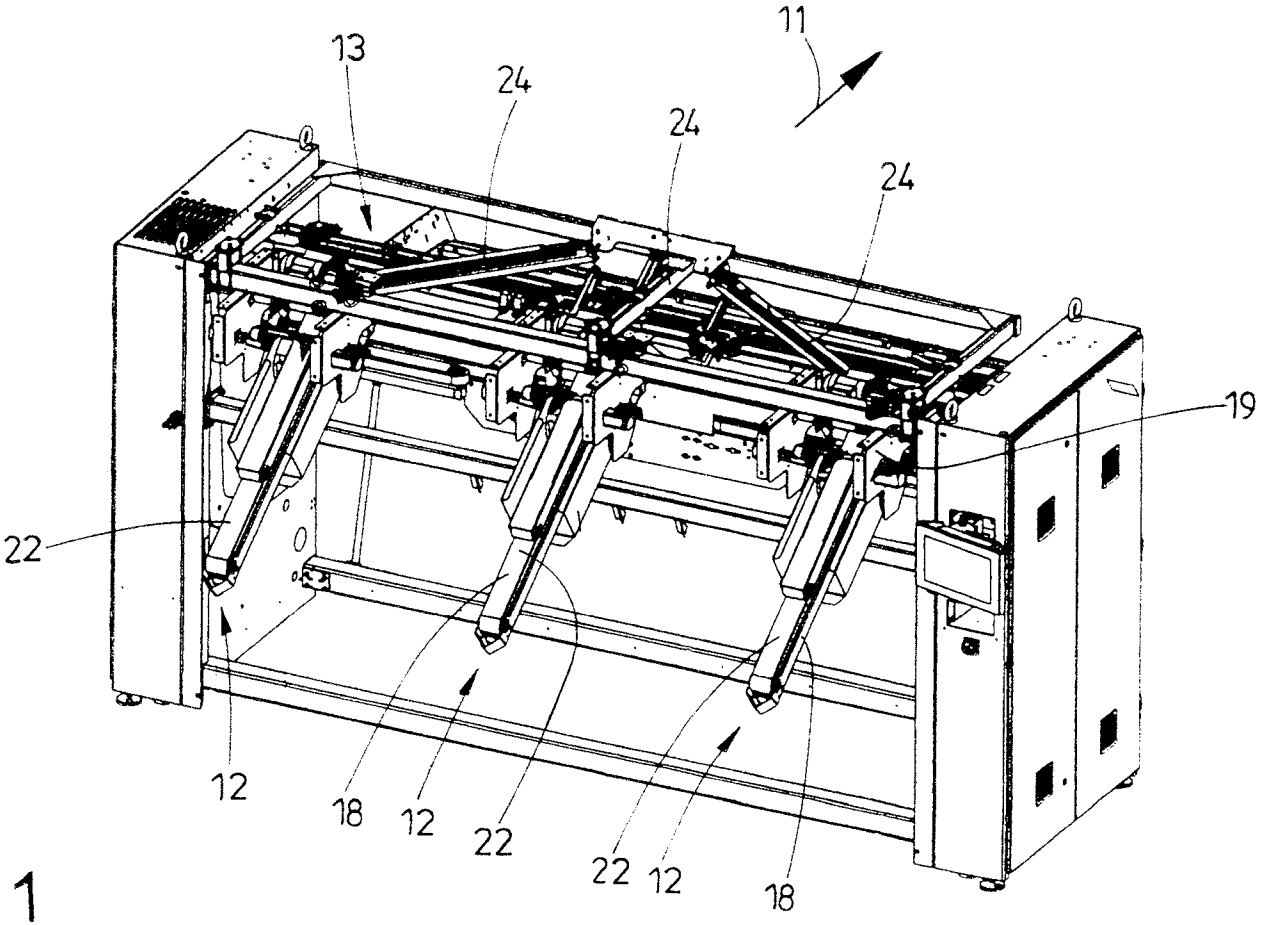
FIG. 1 shows a perspective overall view of an apparatus designed as a feeding machine.
Figure 2:
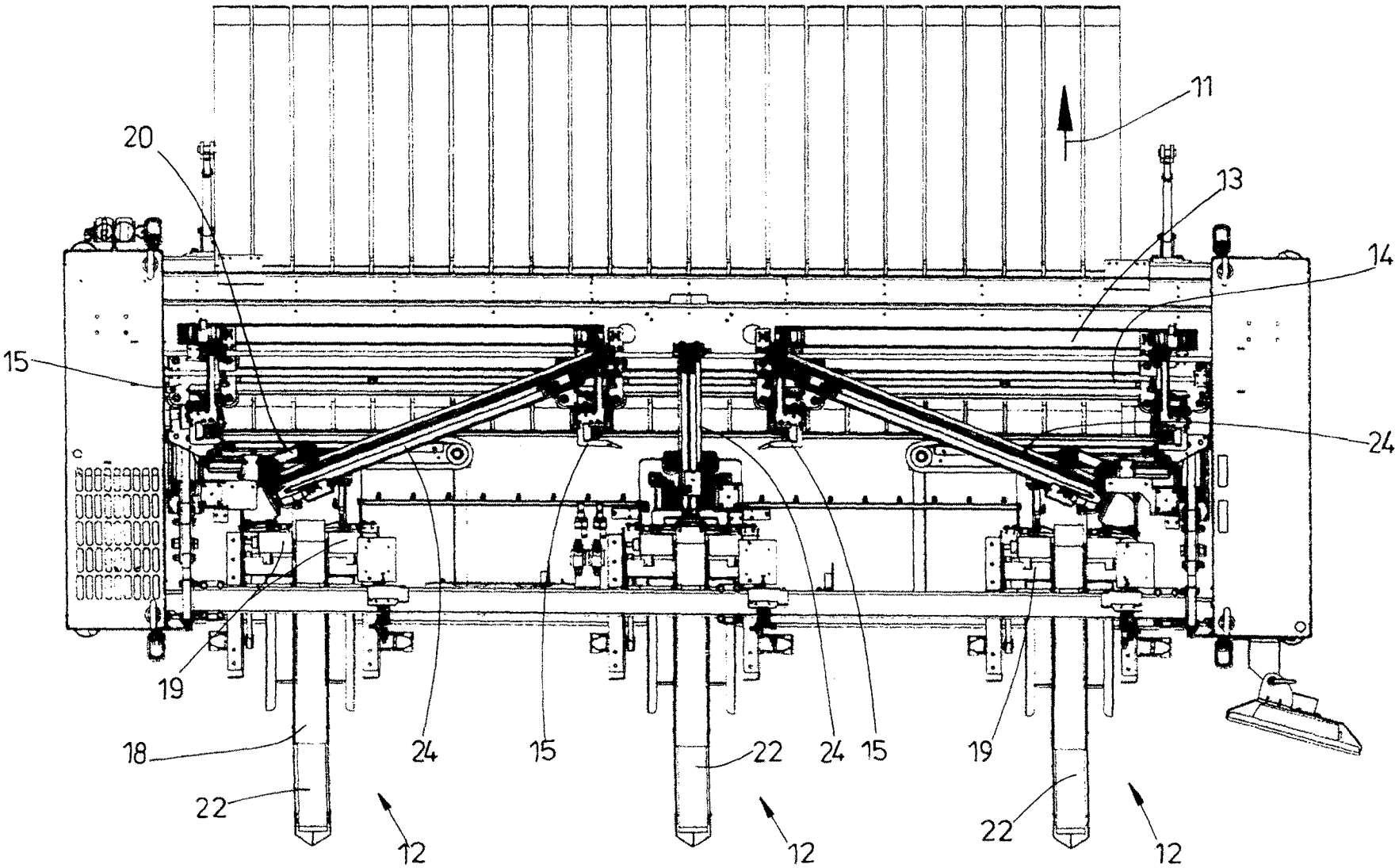
FIG. 2 shows a plan view of the apparatus of FIG. 1.

The figures show an apparatus which is designed as a feeding machine. FIGS. 1 and 2 illustrate the feeding machine completely. The feeding machine serves to feed in each case an individual laundry item 10, illustrated only in FIGS. 3 to 8, specifically in particular a flat laundry item, such as a bed sheet, bed cover, pillowcase, hand towel, tablecloth or the like, in a feeding direction 11 to a mangle (not shown in the figures). However, the apparatus can also serve to feed laundry items 10 to other laundry treatment devices, for example folding machines.

The laundry items 10 are spread out by the apparatus designed as a feeding machine before being fed to a following laundry treatment device. In the technical jargon, this is also referred to as stretching out of the laundry items 10.

The apparatus or feeding machine illustrated here has three identically designed loading stations 12. The loading stations 12 are assigned with equal spacing from one another in a row, which extends transversely to the feeding direction 11, of the front side of the feeding machine. The invention is also suitable for feeding machines having a larger or smaller number of loading stations 12, specifically also for feeding machines having only a single loading station 12. In particular, the invention is also suitable for feeding machines having other loading stations 12. The invention is therefore not intended to be limited to the apparatus shown in the figures and in particular not to the loading stations 12 shown here.

Each loading station 12 has a loading conveyor 18 which transports the laundry item 10 in the feeding direction 11. Each of the identically designed loading conveyors 18 of the loading stations 12 has two narrow, preferably equally wide, belt conveyors 28, 29 each having a circulating conveyor belt. The belt conveyors 28 and 29 are arranged above one another to form a sandwich conveyor, the upper belt conveyor 28 being shorter than the lower belt conveyor 29 in order to form an exposed laying-on region 22 on the front region, which is left free by the shorter upper belt conveyor 28, of an upper strand of the longer lower belt conveyor 29.

The rear end of each loading conveyor 18, as seen in the feeding direction 11, is assigned two corner locators 19. The corner locators 19 first grasp adjacent corners 16 of the subsequent rear transverse edge 17 of the laundry item 10 from the loading conveyor 18. The corner locators 19 are assigned to the rear end of the lower belt conveyor 29. The corner locators 19 are additionally arranged on both sides next to the respective loading conveyor 18, preferably the rear end of the lower belt conveyor 29.

Each of the corner locators 19, which are preferably identically designed but are oriented in mirror-image fashion by being arranged on opposite sides of the rear end of the lower belt conveyor 29, has two rollers 30, 31 which together form a roller pair with parallel longitudinal center axes or axes of rotation. A roller nip 23 is formed between the rollers 30 and 31 of each roller pair. At least one roller 30 or 31 of each corner locator 19 can be rotationally driven. In the exemplary embodiment shown, the roller 31 of each corner locator 19 can be rotationally driven. The driveable rollers 31 of each corner locator 19 which are situated on opposite sides of the loading conveyor 18 and/or belt conveyor 19 can be separately driven independently in the exemplary embodiment shown.

In the exemplary embodiment shown, the roller 31 of each corner locator 19 is assigned a dedicated drive. The drive is formed as a belt drive with a toothed belt 38 and a toothed belt pulley 39 laterally next to each roller 31. Alternatively, however, the drive can also be a direct drive. An electric servomotor preferably serves as drive motor and has a distance measurement device, in particular an angle of rotation measurement device. The distance covered at the circumference of the roller 31 can be determined therefrom. It can also be determined from the common angle of rotation what distance the respective longitudinal edge 34 of the laundry item 10 has covered when running through the rollers 30 and 31 of the respective corner locator 19. Alternatively, it is conceivable to assign the distance sensor of each corner locator 19 directly to the roller 31 and, where appropriate, also to the roller 30 of the respective corner locator 19.

A transfer clamp pair 20 having two transfer clamps 21 follows the corner locators 19 of each loading station 12. The transfer clamp pair 20 of the respective loading station 12 receives adjacent corner regions, preferably corners 16, of the not yet stretched-out (sagging) transverse edge 17 of the laundry item 10 from the corner locators 19 and transports said laundry item to two spreading clamps 15 of a spreading clamp pair of the spreading device 13. The spreading clamps 15 then receive the corners 16 of the transverse edge 17 of the laundry item 10 from the transfer clamps 21 of the transfer clamp pair 20, or the corners 16, which delimit the transverse edge 17 of the laundry item 10, of the still non-spread-out laundry item with still sagging transverse edge 17 are transferred by the transfer clamps 21 of the transfer clamp pair 20 to the spreading clamps 15.

A transfer clamp pair 20 is provided between the corner locators 19 of each loading station 11 and the spreading device 13. In each case a transfer clamp 21 of a transfer clamp pair 20 is here assigned to each of the two opposite corner locators 19 of each loading station 12. For this purpose, the two transfer clamps 21 of each transfer clamp pair 20 are combined. The respective transfer clamp pair 20 thus forms a double clamp for in each case one of the opposite corners 16 of the transverse edge 17, preferably front transverse edge 17, of the laundry item 10.

The transfer clamp pair 20 of each loading station 12 can be moved on a carriage along a rail 24. The rail 24 of the central loading station 12 extends, in the apparatus shown, rectilinearly in the feeding direction 11 along the center of the feeding machine and of the feeding conveyor 17. This rail 24 extends in an upwardly directed manner in the feeding direction. Longer rails 24 extending obliquely upward and in the direction of the spreading device 12 emanate from the outer loading stations 12. The two rails 24 of the opposite outer loading station are of equal length but differently directed, with the result that their rear ends as seen in the feeding direction are directed to converge toward the center of the feeding machine, but terminate upstream of the center, specifically just like the rail 24 assigned to the central loading station 11. The ends of the rails 24 of all transfer clamp pairs 20 lie on a common horizontal (imaginary) line which extends parallel to the at least one rail 24 of the spreading device 13, but at a distance in front and/or above. The lengths of the rails 24 and the positionings of their ends pointing to the spreading device 13 are such that the spreading clamps 15 can run past the transfer clamps 21 in a collision-free manner.

Each loading station 12 is assigned a detection means which, in the exemplary embodiment shown, is a sensor 27. Where appropriate, the detection means can also have a plurality of sensors 27. The loading stations 12 can be assigned further detection means (not shown in the figures).

The sensor 27 forming the detection device is assigned to the upper end of the respective loading conveyor 18. This assignment is such that, in the run-through direction 32 of the respective laundry item 10 through the roller nip 23 of each corner locator 19, that is to say of the two rollers 30 and 31, the sensor 27 follows the corner locators 19 and their rollers 30 and 31. In addition, the sensor 27 is arranged behind the corner locators 19 in such a way that it is situated centrally between same and preferably lies on a vertical longitudinal center plane of the belt conveyors 28 and 29 of the respective loading station 12.

Figure 3:
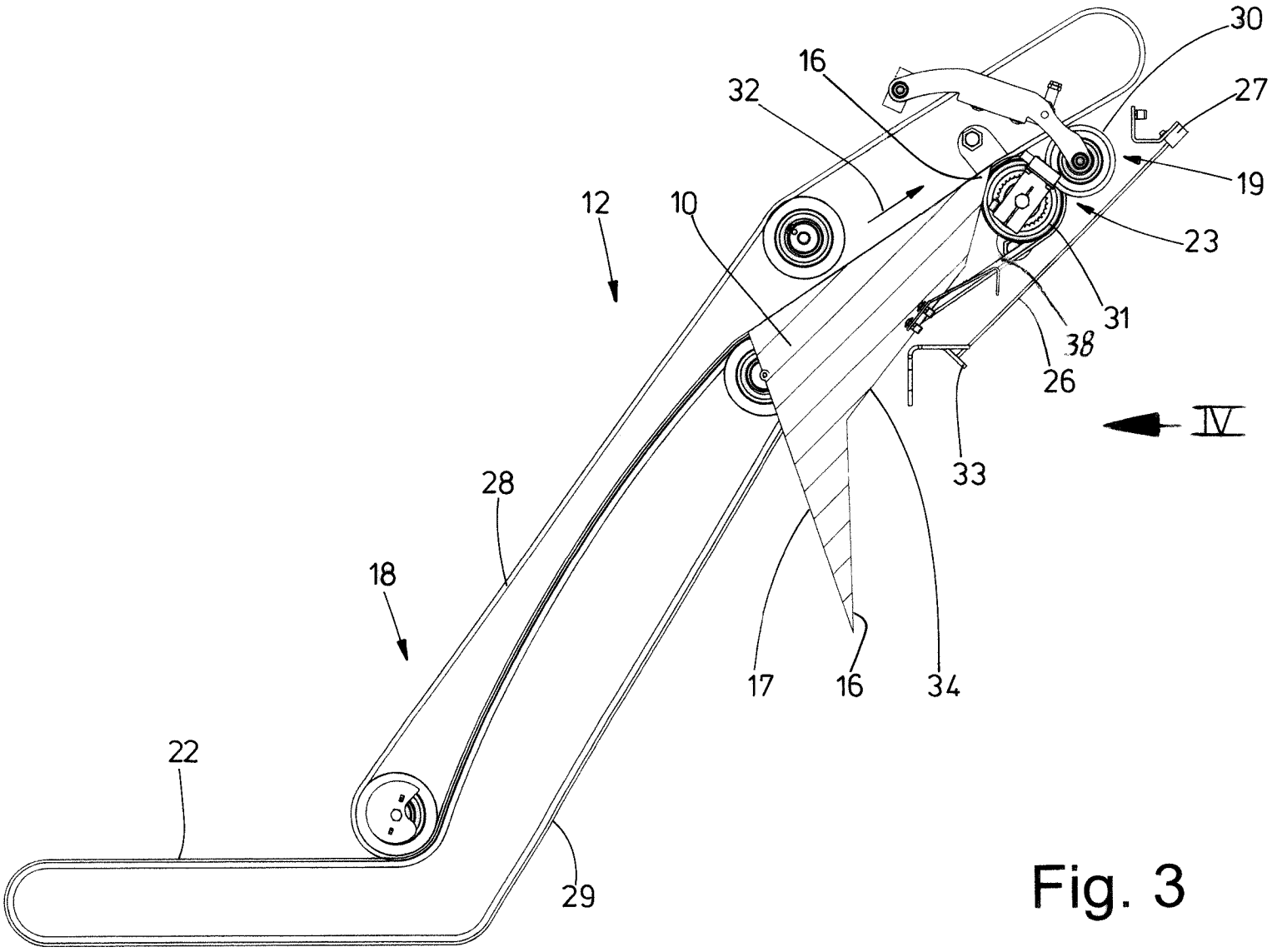
FIG. 3 shows a side view of a loading station of the apparatus of FIGS. 1 and 2 with a laundry item.
Figure 4:
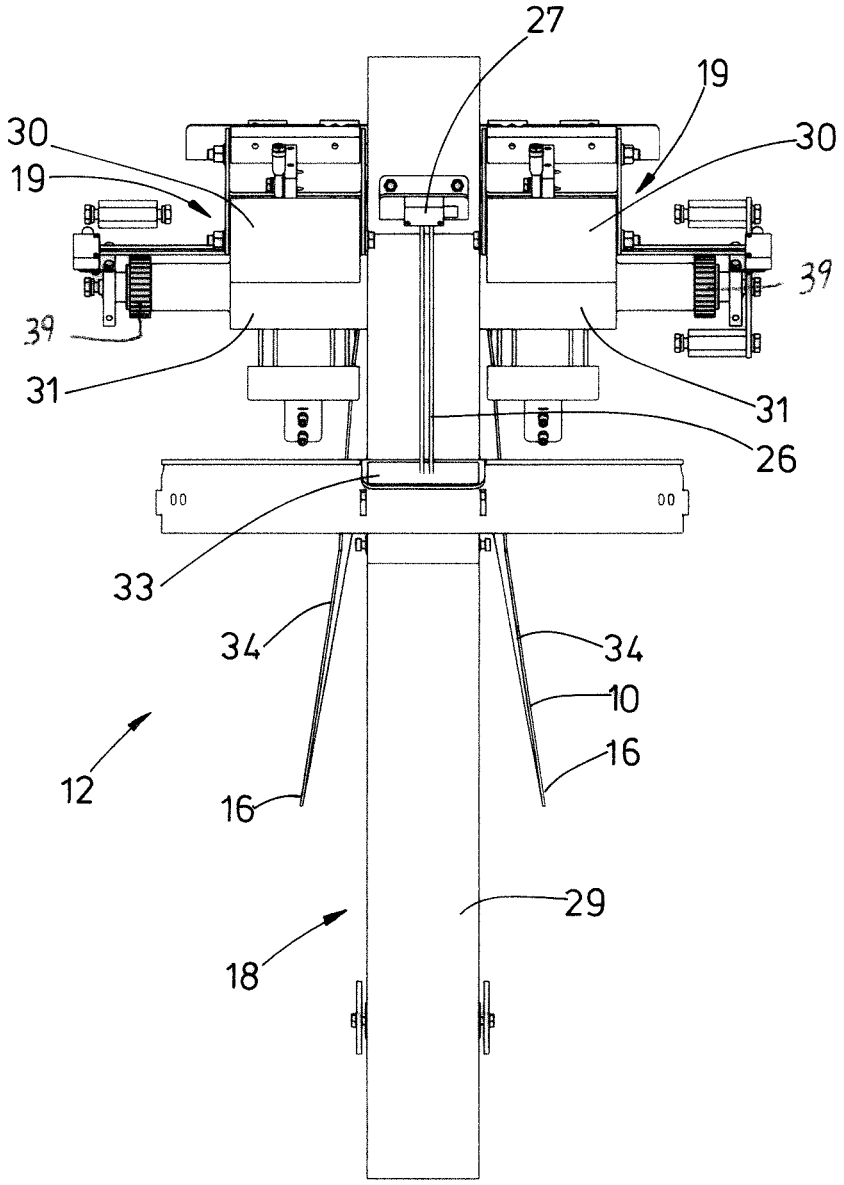
FIG. 4 shows a rear view (with viewing direction along the arrow IV in FIG. 3) of the loading station of FIG. 3.

Furthermore, the assignment of the sensor 27 to the corner locators 19 is such that a measurement beam 26 of the sensor 27 extends parallel below an imaginary plane through the axes of rotation of the rollers 30 and 31 of the two corner locators 19. Here, the measurement beam 26 is directed transversely to the central axes of rotation of the rollers 30 and 31. However, the measurement beam 26 does not extend through the axes of rotation of the rollers 30 and 31 of the corner locators 19 but, in the run-through direction 32 of the laundry item 10 through the loading station 12 and the corner locators 19, behind or below (FIG. 3).

In the exemplary embodiment shown, the sensor 27 is part of a light barrier. For this purpose, the sensor 27 is assigned a reflector 33 spaced apart therefrom. Instead of the reflector 33, a mirror or a receiver can also be provided. The reflector 33 or mirror or receiver is situated on a side, which is directed away from the roller nip 23, of the roller 31 of each corner locator 19. By contrast, the sensor 27 is situated on a side, which is directed away from the roller nip 23, of the other roller 30 of each corner locator 19. As a result, the measurement beam 26 extends transversely to a plane in which there is situated the laundry item 10 after it has run in the run-through direction 32 through the roller nips 23 of the corner locators 19. The sensor 27 can thus detect the running past of the initially front transverse edge 17 and then of the rear transverse edge 17, after which this rear transverse edge 17 becomes the front transverse edge 17, which is then stretched by the spreading device 13 in order to eliminate or at least as far as possible eliminate its sag 35.

The sensor 27 is preferably one which determines an analog measurement signal or an analog measurement value. The respective sensor 27 is furthermore designed in such a way that it very quickly delivers the measurement results, in particular measurement signals following one another closely in time. For this purpose, the sensor 27 delivering analog measurement signals is designed in such a way that it delivers measurement signals, in particular length and/or spacing measurement values, with a starting measurement frequency of below 20 ms.

The method according to invention will be explained below with reference to the above-described apparatus or feeding machine and in particular FIGS. 3 to 8.

In each case an individual laundry item is laid manually onto the laying-on region 22 of the loading conveyor 18 of a respective loading station 12. The laundry item 10 is then transported by the loading conveyor 18 to the two opposite sides of the upper or rear end of the loading conveyor 18 and/or to the corner locators 19 assigned to the latter.

Figure 7:
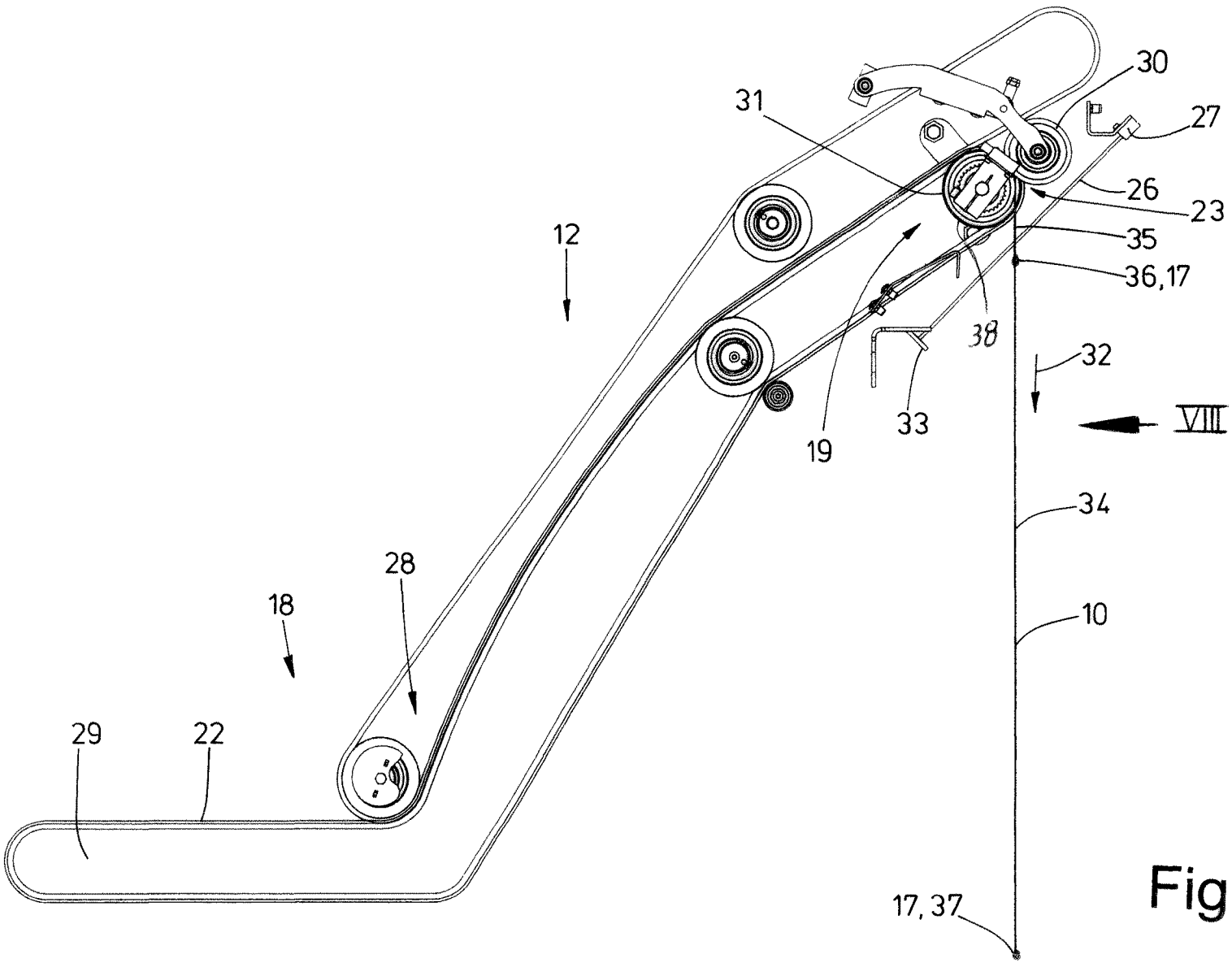
FIG. 7 shows a side view of the loading station analogously to FIGS. 3 and 5.
Figure 8:
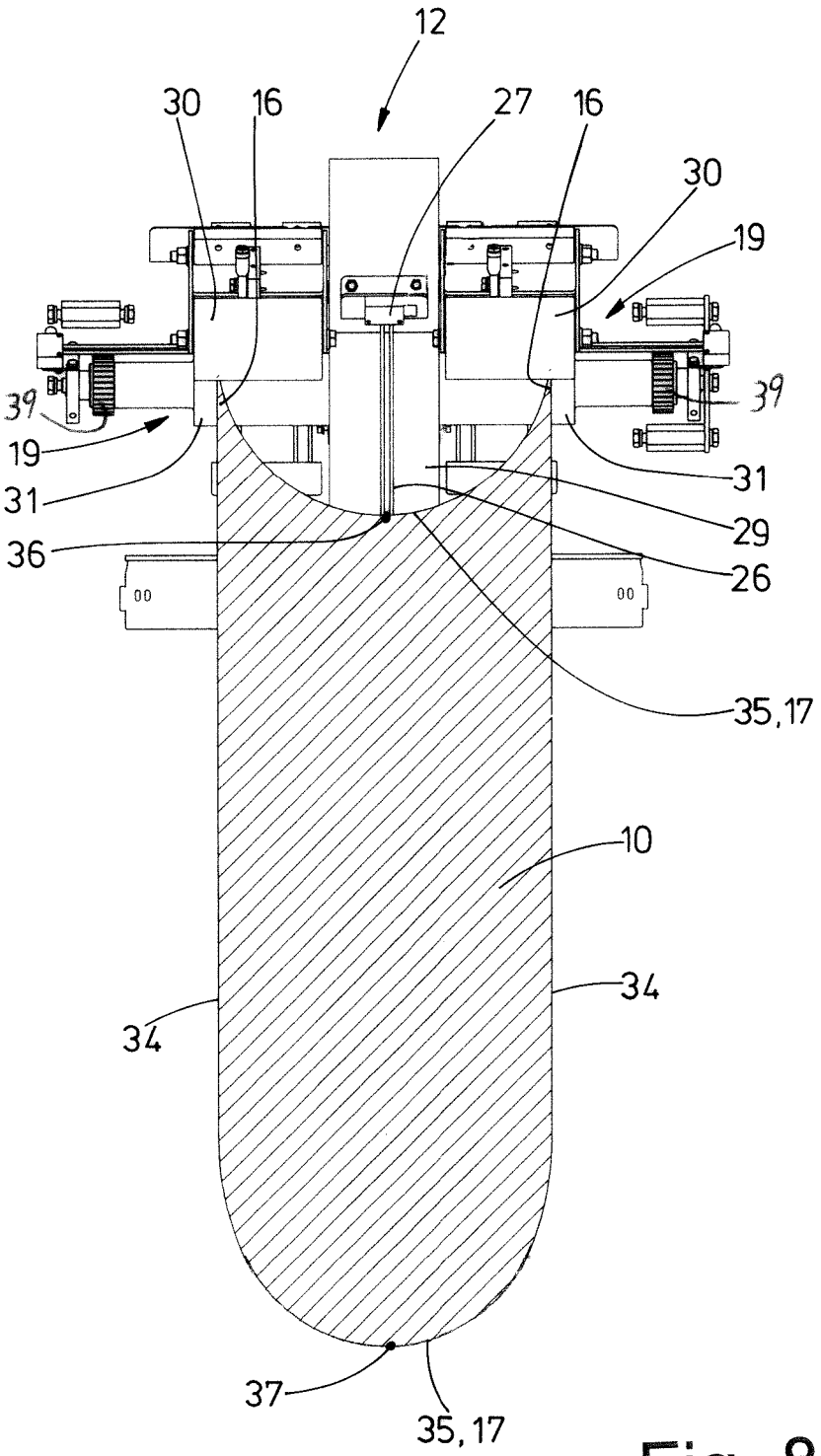
FIG. 8 shows a rear view (with viewing direction along the arrow VIII in FIG. 7) of the loading station of FIG. 7.

The respective laundry item 10 is fed with leading transverse edge 17 to the loading conveyor 18. Each corner locator 19 then receives at first a corner 16 or a corner region of the leading transverse edge 17 of the laundry item 10. Here, opposite corners 16 of the leading transverse edge 17 enter the roller nip 23 of the in each case one corner locator 19 on opposite sides of the loading conveyor 18. By virtue of the rollers 30 and 31 of each corner locator 19, which rotate oppositely in pairs, the laundry item 10 is thus transported at its opposite longitudinal edges 34 through the corner locators 19. Here, each longitudinal edge 34 is situated in the roller nip 23 of a corner locator 19. The transport of the laundry item 10 through the corner locators 19 is stopped as soon as opposite corners 16 or corner regions of the following transverse edge 17 enter or have entered the corner locators 19 (FIGS. 7 and 8). This transverse edge 17 thus becomes the front transverse edge 17 to be stretched out. When corners 16 of the transverse edge 17 run simultaneously into the roller nip 23 of each corner locator 19, the two corner locators 19 are simultaneously stopped. The drives of the rollers 30, 31 of the two corner locators 19 are then also stopped at the same time. However, it can also occur that the opposite corners 16 of the trailing transverse edge 17 run into the roller nips 23 of the corner locators 19 at different times. The drive of the roller pair of a corner locator 19 is then stopped correspondingly later than the drive of the roller pair of that corner locator 19 which holds the leading corner 16.

As soon as the corners 16 of the trailing transverse edge 17 of the laundry item 10 are situated in the corner locators 19, namely the roller nips 23 thereof, the trailing transverse edge 17 becomes the front transverse edge 17 of the laundry item 10 that is to be reduced at least to the most part in terms of sag by the spreading device 13. With this now transverse edge 17 leading, the laundry item 10 spread out or stretched out by the spreading device 13 then runs into the mangle or another laundry treatment machine.

Because the two corner locators 19 are arranged on both sides next to the loading conveyor 18 directly next to the belt conveyors 28, 29 thereof, the transverse edges 17 of the laundry item 10, upon transporting the latter at the opposite longitudinal edges 34 through the corner locators 19, have a still relatively large sag 35. The laundry item 10 is thus not yet spread out and not yet ready for transfer to the mangle or another laundry treatment machine.

According to the invention, a length measurement of the laundry item 10 is carried out when the laundry item 10 runs with opposite longitudinal edges 34 through the corner locators 19 assigned to opposite longitudinal edges 34. This length measurement occurs with the sensor 27 and the reflector 33 or alternatively a mirror, a receiver or another detection means interacting with said sensor. The detection means contactlessly and successively measures the lowest point 36, 37 of the sag 35 of the two transverse edges 17 of the laundry item 10 which follow one another.

Figure 5:
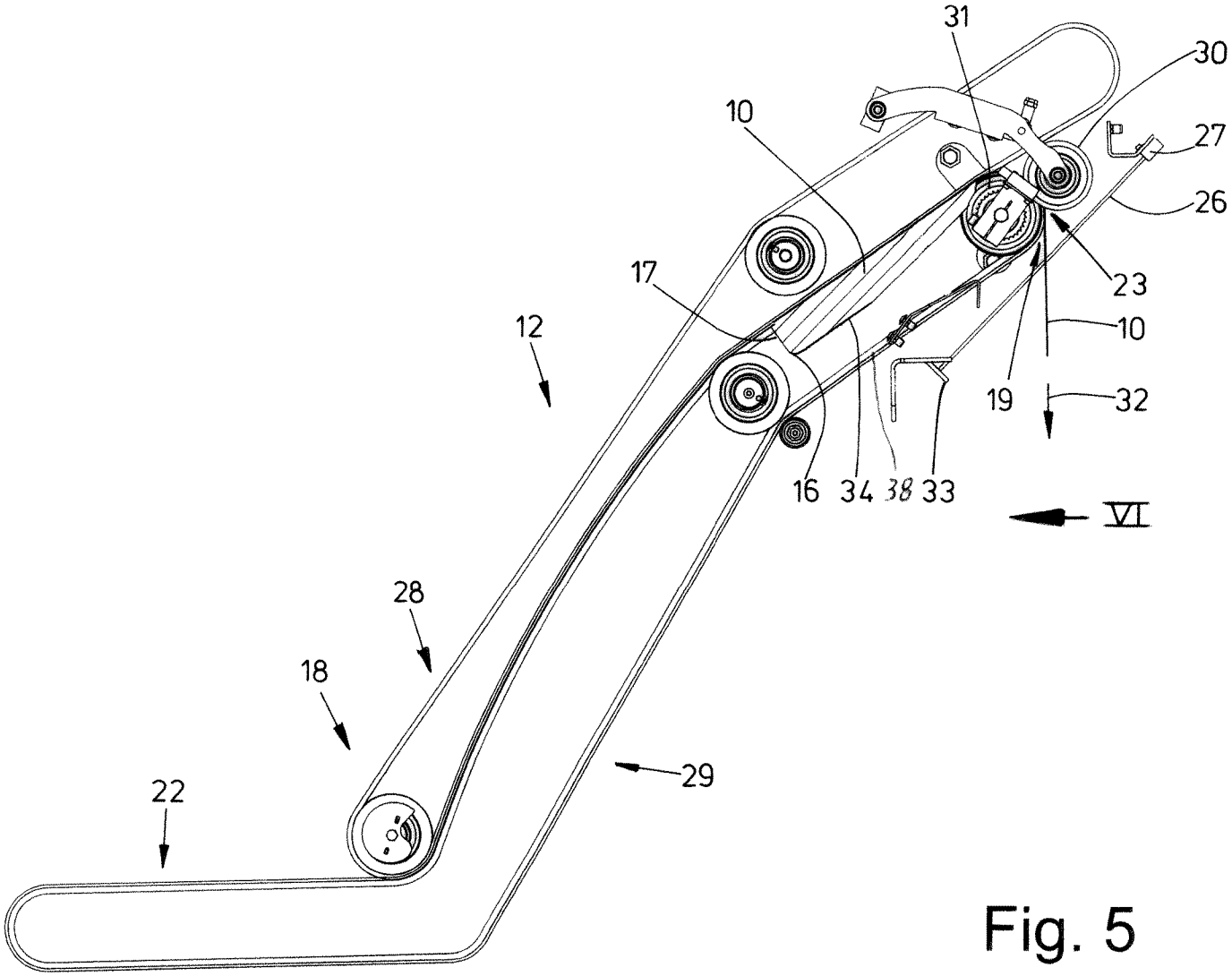
FIG. 5 shows a side view of the loading station analogously to FIG. 3.
Figure 6:
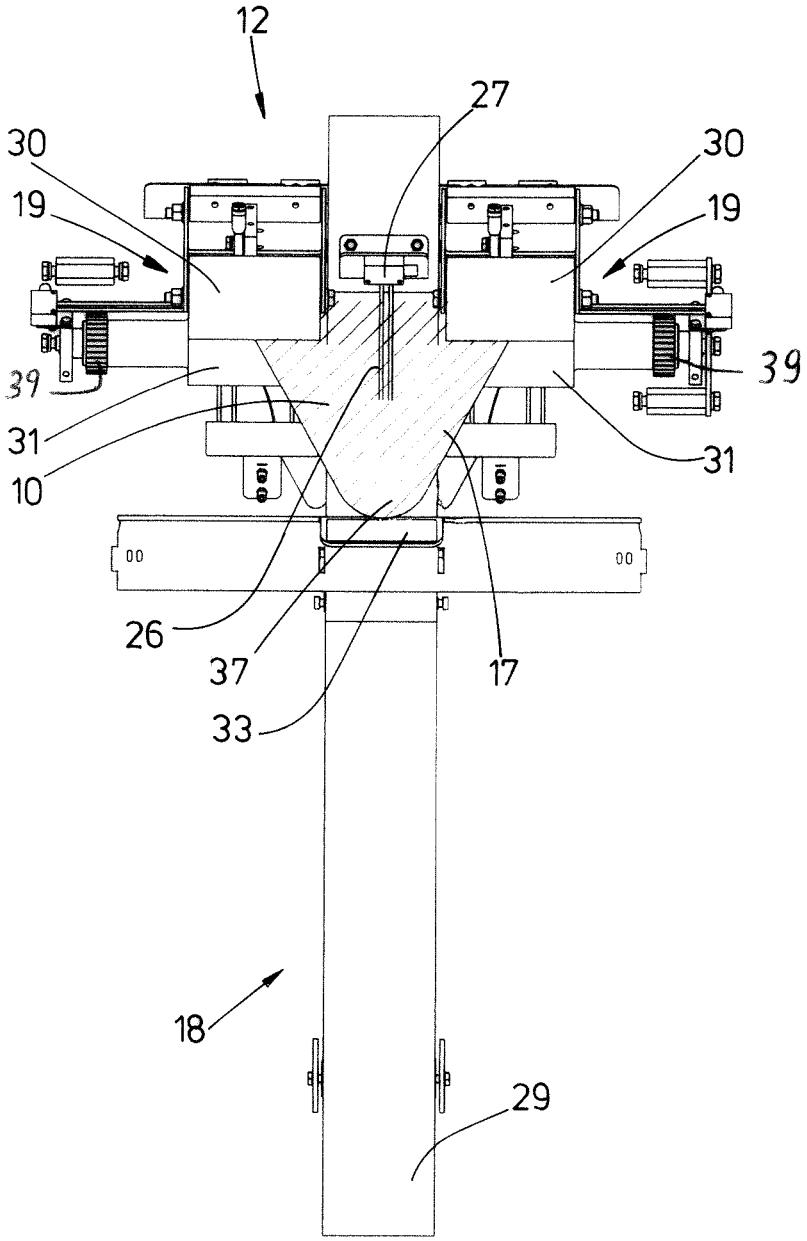
FIG. 6 shows a rear view (with viewing direction along the arrow VI in FIG. 5) of the loading station of FIG. 5.

Upon further transport in the run-through direction 32, the leading transverse edge 17 leaves the influencing region of the corner locators 19 with an outwardly curved, concave transverse edge 17. As soon as a lowest point 37 of this leading and outwardly curved transverse edge 17 has passed through the measurement beam 26 of the sensor 27, the length measurement of the laundry item 10 is started by the laundry item 10 interrupting the measurement beam 26 (FIGS. 5 and 6). If the adjacent longitudinal edges 34 of the laundry item 10 have run for the most part through the corner locators 19, the measurement beam 26 of the sensor 27 is freed again at the lowest point 36 of the inwardly curved, sagging trailing transverse edge 17 (FIGS. 7 and 8). At this time, the length measurement of the laundry item 10 is stopped.

The length of the laundry item 10 can be determined by measuring that time or time period which elapses from the interruption of the measurement beam 26 by the lowest point 37 of the leading transverse edge 17 to the freeing of the measurement beam 26 by the lowest point 36 of the trailing sagging transverse edge 17. The length of the laundry item 10 can thus be determined computationally from the known circumferential speed of the rollers 30, 31 of the roller pair of each corner locator 19 and from the measured time.

Alternatively, the length of the laundry item 10 can also be determined by a direct distance measurement. For this purpose, the driven roller 31 of each corner locator 19 or, where appropriate, the other roller 30 is respectively directly or indirectly assigned a distance sensor. The indirect assignment of the distance sensor to the roller 31 or, where appropriate, to the roller 30 of each corner locator 19 occurs at the drive of the relevant roller 31 or 30. A servomotor serving to drive the respective roller 31 or 30 is preferably provided with a distance sensor. The distance sensor is preferably an angle of rotation sensor. It is possible to determine from the angle of rotation, on the basis of the diameter of the respective roller 31 or 30, where appropriate in conjunction with a transmission ratio of the drive, the distance which has been covered by the circumference of the roller 31 or 30 during the running of the leading transverse edge 17 to the trailing transverse edge 17 past the respective measurement beam 26.

The measurement of the length of the laundry item 10 occurs according to the above-described method while the laundry item 10 is transported through the corner locators 19. The measurement preferably occurs before stopping the rotary drive of the rollers 30, 31 of the corner locators 19, that is to say before the corners 16 now delimiting the front transverse edge 17 have run into the corner locators 19. The length measurement of the laundry item 10 is therefore concluded before the drives of the rollers 30, 31 of the corner locators 19 are stopped, in order for the opposite corners 16 of the now front transverse edge 17 that are found by the corner locators 19 to be transferred to in each case a transfer clamp pair 20. Before the transfer clamp pair 20 transfers the corners 16 of the still sagging front transverse edge 17 of the respective laundry item 10 to the spreading clamps 15 of the spreading device 13, the width of the laundry item 10 or the length of the front transverse edge 17 is determined from the determined length of said laundry item.

The length of the front transverse edge 17, which corresponds to the width of the laundry item 10, is determined on the basis of the previously measured length of the laundry item 10 in that the width of the respective laundry item 10 which belongs to the measured length is read from a data bank. Here, the starting point is the finding that laundry items 10 are customarily processed with standard dimensions. Accordingly, a laundry item 10 has a certain length and a corresponding, defined width and thus length of the transverse edge 17 extending transversely to the feeding direction 11. The data bank or memory belongs to the apparatus and is a constituent part of the method. As soon as the length of a laundry item 10 has been measured, while using this length the width of the laundry item 10 belonging to this measured length is determined and retrieved or read from the data bank. This width can then be used for the subsequent spreading out of the laundry item 10 by the spreading device 13.

Initially stored in the data bank are the lengths of all occurring laundry items 10 and the associated widths or length-width ratios. Should it occur that a length is measured which has not been stored with the associated width in the data bank, this can indicate an incorrect measurement or a "foreign" laundry item 10 situated in a batch of laundry. Such laundry items 10 are then separated out, that is to say not fed to the spreading device 13, specifically in particular because it cannot spread out laundry items 10 whose width cannot be determined.

After the width of the laundry item belonging to the measured length has been automatically taken from the data bank by the control, the length of the front transverse edge 17, which is to be spread by the spreading device 13, of the laundry item 10 is also known. This is because the length of the transverse edge 17 corresponds to the width of the laundry item 10. On the basis of the determined length of the front transverse edge 17, the laundry item 10 is then spread out by the spreading device 13 by targeted movement apart of the spreading clamps 15 holding the two opposite corners 16 of the transverse edge 17, and at the same time the front transverse edge 17 is stretched to such an extent that its sag 35 is eliminated or is at least as far as possible eliminated without overstretching of the transverse edge 17.

It is also conceivable that the movement apart of the spreading clamps 15 occurs in dependence on the previously determined length of the transverse edge 17 in a plurality of stages or steps with in each case different speeds. For example, the spreading clamps 15 are first of all moved apart relatively quickly, but retarded shortly before reaching the calculated length of the transverse edge 17 and moved apart at a lower speed in order to slowly completely spread out the laundry item 10. This allows an exact approach to the position of the spreading clamps 15 which leads to the greatest possible spreading out of the laundry item 10 and allows the greatest possible care of the laundry item 10 during the complete and/or greatest possible spreading out or stretching.

LIST OF REFERENCE SIGNS

10 laundry item
11 feeding direction
12 loading station
13 spreading device
15 spreading clamp
16 corner
17 transverse edge
18 loading conveyor
19 corner locator
20 transfer clamp pair
21 transfer clamp
22 laying-on region
23 roller nip
24 rail
26 measurement beam
27 sensor
28 belt conveyor
29 belt conveyor

30 roller
31 roller
32 run-through direction
33 reflector
34 longitudinal edge
35 sag
36 lowest point
37 lowest point
38 toothed belt
39 toothed belt pulley

What is claimed is:

1. A method for feeding laundry items to a mangle or to another laundry treatment device, a respective laundry item (10) held at two adjacent corner regions or corners (16) of an upper transverse edge (17) by two spreading clamps of a spreading device (13) being spread out by targeted movement apart of the spreading clamps (15) while taking into consideration the determined length of the transverse edge (17), in order to eliminate or at least as far as possible eliminate a sag (35) of the front transverse edge (17) of the laundry item (10), wherein, before transferring the corner regions or corners (16) of the front transverse edge (17) of the laundry item (10) to the spreading clamps (15), with the laundry item (10) held by holding means arranged upstream of the spreading device (13), a measurement of said laundry item is carried out and the length of the front transverse edge (17) of the laundry item (10) is determined therefrom.

2. The method as claimed in claim 1, wherein, before transferring the laundry item (10) to the spreading device (13), the length of the front transverse edge (17), which corresponds to the width of the laundry item (10), is derived from a measurement of the length of the laundry item (10) between the front transverse edge (17) held by the holding means and the opposite rear transverse edge (17).

3. The method as claimed in claim 1, wherein the length of the laundry item (10) is determined by at least one detection means with the laundry item (10) held with sagging transverse edges (17) by the holding means.

4. A method for feeding laundry items to a mangle or to another laundry treatment device, a respective laundry item (10) held at two adjacent corner regions or corners (16) of an upper transverse edge (17) by two spreading clamps of a spreading device (13) being spread out by targeted movement apart of the spreading clamps (15) while taking into consideration the determined length of the transverse edge (17), in order to eliminate or at least as far as possible eliminate a sag (35) of the front transverse edge (17) of the laundry item (10), wherein, before transferring the corner regions or corners (16) of the front transverse edge (17) of the laundry item (10) to the spreading clamps (15), with the laundry item (10) held by holding means arranged upstream of the spreading device (13), a measurement of said laundry item is carried out and the length of the front transverse edge (17) of the laundry item (10) is determined therefrom, wherein, on the basis of the determined length of the laundry item (10) held on the holding means, the length of the transverse edge (17), which corresponds to the width of the laundry item (10), is derived from length-width ratios of different laundry items (10) stored in a data bank.

5. A method for feeding laundry items to a mangle or to another laundry treatment device, a respective laundry item (10) held at two adjacent corner regions or corners (16) of an upper transverse edge (17) by two spreading clamps of a spreading device (13) being spread out by targeted movement apart of the spreading clamps (15) while taking into consideration the determined length of the transverse edge (17), in order to eliminate or at least as far as possible eliminate a sag (35) of the front transverse edge (17) of the laundry item (10), wherein, before transferring the corner regions or corners (16) of the front transverse edge (17) of the laundry item (10) to the spreading clamps (15), with the laundry item (10) held by holding means arranged upstream of the spreading device (13), a measurement of said laundry item is carried out and the length of the front transverse edge (17) of the laundry item (10) is determined therefrom, wherein, after determining the length of the laundry item (10) and the length, derived therefrom, of the front transverse edge (17) of the laundry item (10), with the laundry item (10) held by the holding means, said laundry item is transferred directly from the holding means to the spreading clamps (15) or is first transferred to other holding means which then transfer the laundry item (10) with adjacent corners (16) or corner regions of the front transverse edge (17) to the spreading clamps (15).

6. A method for feeding laundry items to a mangle or to another laundry treatment device, a respective laundry item (10) held at two adjacent corner regions or corners (16) of an upper transverse edge (17) by two spreading clamps of a spreading device (13) being spread out by targeted movement apart of the spreading clamps (15) while taking into consideration the determined length of the transverse edge (17), in order to eliminate or at least as far as possible eliminate a sag (35) of the front transverse edge (17) of the laundry item (10), wherein, before transferring the corner regions or corners (16) of the front transverse edge (17) of the laundry item (10) to the spreading clamps (15), with the laundry item (10) held by holding means arranged upstream of the spreading device (13), a measurement of said laundry item is carried out and the length of the front transverse edge (17) of the laundry item (10) is determined therefrom, wherein the length of the laundry item (10) is determined by at least one detection means from the spacing of the transverse edges (17) of the laundry item (10) when the transverse edges (17) of the laundry item (10) run successively past the holding means.

7. A method for feeding laundry items to a mangle or to another laundry treatment device, a respective laundry item (10) held at two adjacent corner regions or corners (16) of an upper transverse edge (17) by two spreading clamps of a spreading device (13) being spread out by targeted movement apart of the spreading clamps (15) while taking into consideration the determined length of the transverse edge (17), in order to eliminate or at least as far as possible eliminate a sag (35) of the front transverse edge (17) of the laundry item (10), wherein, before transferring the corner regions or corners (16) of the front transverse edge (17) of the laundry item (10) to the spreading clamps (15), with the laundry item (10) held by holding means arranged upstream of the spreading device (13), a measurement of said laundry item is carried out and the length of the front transverse edge (17) of the laundry item (10) is determined therefrom, wherein, on the basis of the length, determined upstream of the spreading device (13), of the front transverse edge (17) of the laundry item (10), after the transfer thereof to the spreading clamps (15), the latter are moved apart in a targeted and controlled manner to spread out the laundry item (10) to the smallest possible sag (35) of the front transverse edge (17) of the laundry item (10).

8. An apparatus, in particular feeding machine, for feeding laundry items (10) to a mangle or to another laundry treatment device, having a spreading device (13) which has at least two spreading clamps (15), which can be moved apart and together, for adjacent corner regions or corners (16) of a front transverse edge (17) of the respective laundry item (10), and having at least one detection means for determining at least one dimension of the laundry item (10), wherein the at least one detection means is assigned to holding means of the laundry item (10) that are arranged upstream of the spreading device.

9. The apparatus as claimed in claim 8, wherein the at least one detection means is arranged between the holding means or corner locators (19) assigned to opposite longitudinal edges (34) of the laundry item (10).

10. The apparatus as claimed in claim 8, wherein the at least one detection means is arranged between the holding means or corner locators (19) assigned to opposite longitudinal edges (34) of the laundry item (10) in such a way that the sagging transverse edges (17) can be detected at at least one lowest point (36, 37) of the respective sag (35) by the at least one measurement beam (26) of the at least one detection means, directed transversely to the surface of the laundry item (10).

11. An apparatus, in particular feeding machine, for feeding laundry items (10) to a mangle or to another laundry treatment device, having a spreading device (13) which has at least two spreading clamps (15), which can be moved apart and together, for adjacent corner regions or corners (16) of a front transverse edge (17) of the respective laundry item (10), and having at least one detection means for determining at least one dimension of the laundry item (10), wherein the at least one detection means is assigned to holding means of the laundry item (10) that are arranged upstream of the spreading device, wherein the holding means are designed as corner locators (19) which are assigned to opposite longitudinal edges (34) of the laundry item (10) and which transport the laundry item (10) at the opposite longitudinal edges (34) starting from a leading transverse edge (17) to the opposite trailing transverse edge (17).

12. The apparatus as claimed in claim 11, wherein the at least one detection means is arranged between the holding means or corner locators (19) assigned to opposite longitudinal edges (34) of the laundry item (10).

13. The apparatus as claimed in claim 11, wherein the at least one detection means is arranged between the holding means or corner locators (19) assigned to opposite longitudinal edges (34) of the laundry item (10) in such a way that the sagging transverse edges (17) can be detected at at least one lowest point (36, 37) of the respective sag (35) by the at least one measurement beam (26) of the at least one detection means, directed transversely to the surface of the laundry item (10).

* * * * *